US009803886B2

(12) United States Patent
Chang

(10) Patent No.: US 9,803,886 B2
(45) Date of Patent: Oct. 31, 2017

(54) INSTANTANEOUS WATER-HEATING DISPENSING DEVICE AND HEATING MODULE THEREOF

(71) Applicant: Da Wei Lin, New Taipei (TW)

(72) Inventor: Yun-Shan Chang, San Jose, CA (US)

(73) Assignees: Yun-Shan Chang, San Jose, CA (US); Da Wei Lin, New Taipei (TW)

( * ) Notice: Subject to any disclaimer, the term of this patent is extended or adjusted under 35 U.S.C. 154(b) by 339 days.

(21) Appl. No.: 14/014,588

(22) Filed: Aug. 30, 2013

(65) Prior Publication Data

US 2015/0063794 A1 Mar. 5, 2015

(51) Int. Cl.

| | |
|---|---|
| ***F24H 1/10*** | (2006.01) |
| ***H05B 3/78*** | (2006.01) |
| ***H05B 3/26*** | (2006.01) |
| ***H05B 3/46*** | (2006.01) |
| ***F24H 1/12*** | (2006.01) |
| *F24H 9/00* | (2006.01) |

(52) U.S. Cl.

CPC ..... *F24H 1/105* (2013.01); *F24H 1/121* (2013.01); *H05B 3/262* (2013.01); *H05B 3/46* (2013.01); *F24H 9/0015* (2013.01); *F24H 2250/02* (2013.01); *H05B 2203/014* (2013.01); *H05B 2203/02* (2013.01); *H05B 2203/022* (2013.01)

(58) Field of Classification Search

None

See application file for complete search history.

(56) References Cited

U.S. PATENT DOCUMENTS 1,188,952 A * 6/1916 Laird ..... F24H 1/102 392/473
1,922,351 A * 8/1933 Brown ..... F22D 1/02 122/367.3
2,565,816 A * 8/1951 Jones ..... F02M 21/00 165/157
3,782,456 A * 1/1974 Gusmer ..... F28D 7/0041 165/164
4,122,828 A * 10/1978 DiPeri ..... F24J 2/202 126/400

(Continued)

FOREIGN PATENT DOCUMENTS

CN 1965743 A 5/2007
CN 201837073 U 5/2011

(Continued)

*Primary Examiner* — Thor Campbell
(74) *Attorney, Agent, or Firm* — Rosenberg, Klein & Lee

(57) ABSTRACT

The present invention discloses a water dispensing device including a water tank and at least one heating module. Each heating module includes a body and a heating plate, the body includes a groove, an input terminal located one end of the groove and connected the water tank, an output terminal located other end of the groove, and a plurality of ribs. The ribs formed on the bottom surface of the groove and the height is less than a depth of the groove, two arms of the ribs connect the sidewalls of the groove, and the density of the arrangement is decremented from the input terminal to the output terminal. The heating plate is covered the groove and doesn't contact the ribs, and the surface of the heating plate which is deviated from the groove has a plurality of heating units, be used to convert the power into the heat energy.

19 Claims, 3 Drawing Sheets

(56) References Cited

U.S. PATENT DOCUMENTS 4,343,988 A * 8/1982 Roller ..... A47J 31/545 165/165
4,546,697 A * 10/1985 Schaeffer ..... A47J 31/542 165/84
4,563,571 A * 1/1986 Koga ..... H05B 3/42 219/543
4,687,907 A * 8/1987 Barkley ..... B23K 3/047 228/234.1
4,735,609 A * 4/1988 Comeau ..... A61M 5/44 165/170
6,336,003 B1 * 1/2002 Mitsunaga ..... A61M 5/44 392/470
6,788,885 B2 * 9/2004 Mitsunaga ..... A61M 5/44 392/470
8,180,207 B2 * 5/2012 Shirai ..... E03D 9/08 392/465
8,541,721 B2 * 9/2013 Moskal ..... B21D 53/02 126/400
8,607,694 B2 * 12/2013 Blanc ..... A47J 31/54 392/479
9,080,795 B2 * 7/2015 Lee ..... F24D 5/12
2002/0181948 A1 * 12/2002 Akahane ..... A61F 7/0085 392/470
2006/0237166 A1 * 10/2006 Otey ..... F28F 3/02 165/80.4
2007/0240867 A1 * 10/2007 Amano ..... F28F 3/12 165/168
2009/0060481 A1 * 3/2009 Kaastra ..... F24H 1/121 392/471
2010/0232110 A1 * 9/2010 Ippoushi ..... F25B 39/02 361/699
2014/0046248 A1 * 2/2014 Fini ..... A61M 1/28 604/29
2014/0131343 A1 * 5/2014 Walsh ..... F24H 3/002 219/217

FOREIGN PATENT DOCUMENTS

CN 202262843 U 6/2012
CN 102914197 A 2/2013

* cited by examiner

INSTANTANEOUS WATER-HEATING DISPENSING DEVICE AND HEATING MODULE THEREOF

BACKGROUND OF THE INVENTION

1. Field of the Invention

The present disclosure relates to a water dispensing device; in particular, to a water dispensing device for providing instantaneous heating and a heating module thereof.

2. Description of Related Art

With the rise of living standards in people's lives, the quality of drinking water is emphasized. Heating water by gas or electric stoves to obtain hot water is substituted by storing readily available hot water in water dispensers or hot water bottles.

However, water dispensers or hot water bottles require heating units to heat the water to a boil and continually heat the water to maintain it at a predetermined temperature (e.g. eighty degrees Celsius or a hundred degrees Celsius).

Even though these types of water dispensers or hot water bottles provide readily available hot water, the need to maintain the hot water in the hot water compartment at a predetermined temperature results in unnecessary waste, not meeting the energy saving policy advocated by the government in recent years.

Additionally, the consumption rate of hot water varies by season or time. For example, the consumption rate of hot water during the winter is larger than the consumption rate of hot water during the summer. Therefore, if the hot water is indiscriminately kept at maximum capacity in the hot water compartment regardless of practical needs, more electrical power is required to maintain the water in the hot water compartment at a predetermined temperature, which is an ineffective method of use.

SUMMARY OF THE INVENTION

The object of the present disclosure is to provide a water dispensing device for providing instantaneous heating and a heating module thereof. Ribs in the heating module and correspondingly disposed heating units create thermal convection in the water flowing through the heating module resulting in good heat exchange rate.

An embodiment of the present disclosure provides a water dispensing device for providing instantaneous heating, electrically connected to an external power source, and mainly comprising a water tank and at least one heating module. Each of the heating modules includes a body and a heating plate. The body includes a groove, an input terminal, an output terminal and a plurality of ribs. The input terminal is positioned at one end of the groove and is connected to the water tank. The output terminal is positioned at the other end of the groove. The plurality of ribs is formed at the bottom surface of the groove and the height of protrusion of the ribs is smaller than the depth of the groove. Two arms of each of the ribs are respectively connected to two sidewalls of the groove. The arrangement density of the plurality of ribs decreases from the input terminal to the output terminal. The heating plate covers the opening of the groove and is not in contact with the plurality of ribs. The face of the heating plate facing away from the groove has a plurality of heating units. Each of the heating units corresponds to a position between two neighboring ribs. The plurality of heating units convert external power source into heat, for heating water injected from the water tank. When water flows through the region between two neighboring ribs and the heating plate, water proximal to the heating plate is instantaneously heated and convective current is created, forming a convection cell in the region between the two neighboring ribs and the heating plate.

An embodiment of the present disclosure provides a heating module including a body and a heating plate. The body includes a groove, an input terminal, an output terminal and a plurality of ribs. The input terminal is positioned at one end of the groove and is connected to the water tank. The output terminal is positioned at the other end of the groove. The plurality of ribs is formed at the bottom surface of the groove and the height of protrusion of the ribs is smaller than the depth of the groove. Two arms of each of the ribs are respectively connected to two sidewalls of the groove. The arrangement density of the plurality of ribs decreases from the input terminal to the output terminal. The heating plate covers the opening of the groove and is not in contact with the plurality of ribs. The face of the heating plate facing away from the groove has a plurality of heating units. Each of the heating units corresponds to a position between two neighboring ribs. The plurality of heating units convert external power source into heat, for heating water injected from the water tank.

An embodiment of the present disclosure provides a body including a groove, an input terminal, an output terminal and a plurality of ribs. The input terminal is positioned at one end of the groove and is connected to the water tank. The output terminal is positioned at the other end of the groove. The plurality of ribs is formed at the bottom surface of the groove and the height of protrusion of the ribs is smaller than the depth of the groove. Two arms of each of the ribs are respectively connected to two sidewalls of the groove. The arrangement density of the plurality of ribs decreases from the input terminal to the output terminal.

In summary of the above, an embodiment of the present disclosure provides a water dispensing device for providing instantaneous heating and a heating module thereof. The heating module mainly includes a body and a heating plate. Through the design of spaced ribs and heating units on the heating plate corresponding to gaps between neighboring ribs, when water flows through the regions between two neighboring ribs and the heating plate, water proximal to the heating plate is instantaneously heated and convective current is created, forming a convection cell in the region between the two neighboring ribs and the heating plate.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

[Embodiment of a Water Dispensing Device for Providing Instantaneous Heating]

Figure 1:
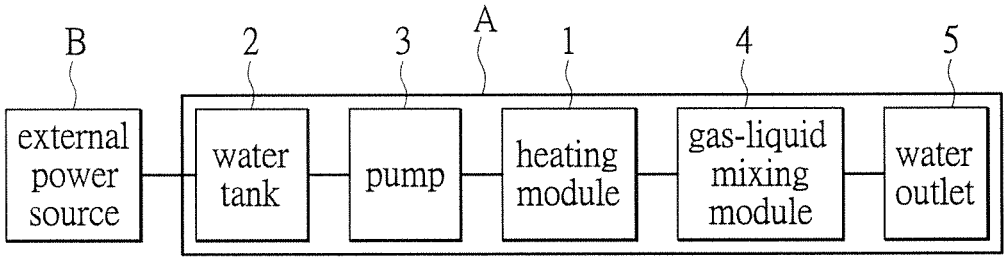
FIG. 1 shows a function block diagram of a water dispensing device for providing instantaneous heating according to an embodiment of the present disclosure.

FIG. 1 shows a function block diagram of a water dispensing device for providing instantaneous heating according to an embodiment of the present disclosure. As shown in FIG. 1, the water dispensing device for providing instantaneous heating A is electrically connected to an external power source B. The water dispensing device for providing instantaneous heating A includes a heating module 1, a water tank 2, a pump 3, a gas-liquid mixing module 4, and a water outlet 5. One end of the heating module 1 is connected to the water tank 2 via the pump 3, and the other end of the heating module 1 is sequentially connected to the gas-liquid mixing module 4 and the water outlet 5.

The water tank 2 is removably disposed on the water dispensing device for providing instantaneous heating A, and is used for storing liquid to be heated by the water dispensing device for providing instantaneous heating A. The present disclosure does not limit the volume of the liquid that can be stored in the water tank 2.

The pump 3 pumps the liquid stored in the water tank 2 to the heating module 1. The present disclosure does not limit the flow rate provided by the pump 3. In practice, the pump 3 can be a positive displacement pump, a mechanical pump or an electromagnetic pump. The present disclosure is not limited thereto.

The heating module 1 creates turbulence in the liquid flowing through the heating module 1 during heating, thereby increasing the heat exchange rate. In practice, each water dispensing device for providing instantaneous heating can have at least one heating module 1. In other words, when more heating modules 1 are disposed, the amount of hot water outputted by the water outlet 5 is higher. Additionally, the present disclosure does not limit whether the external power source B provides alternating current or direct current. The following details the components of the heating module 1.

Figure 2:
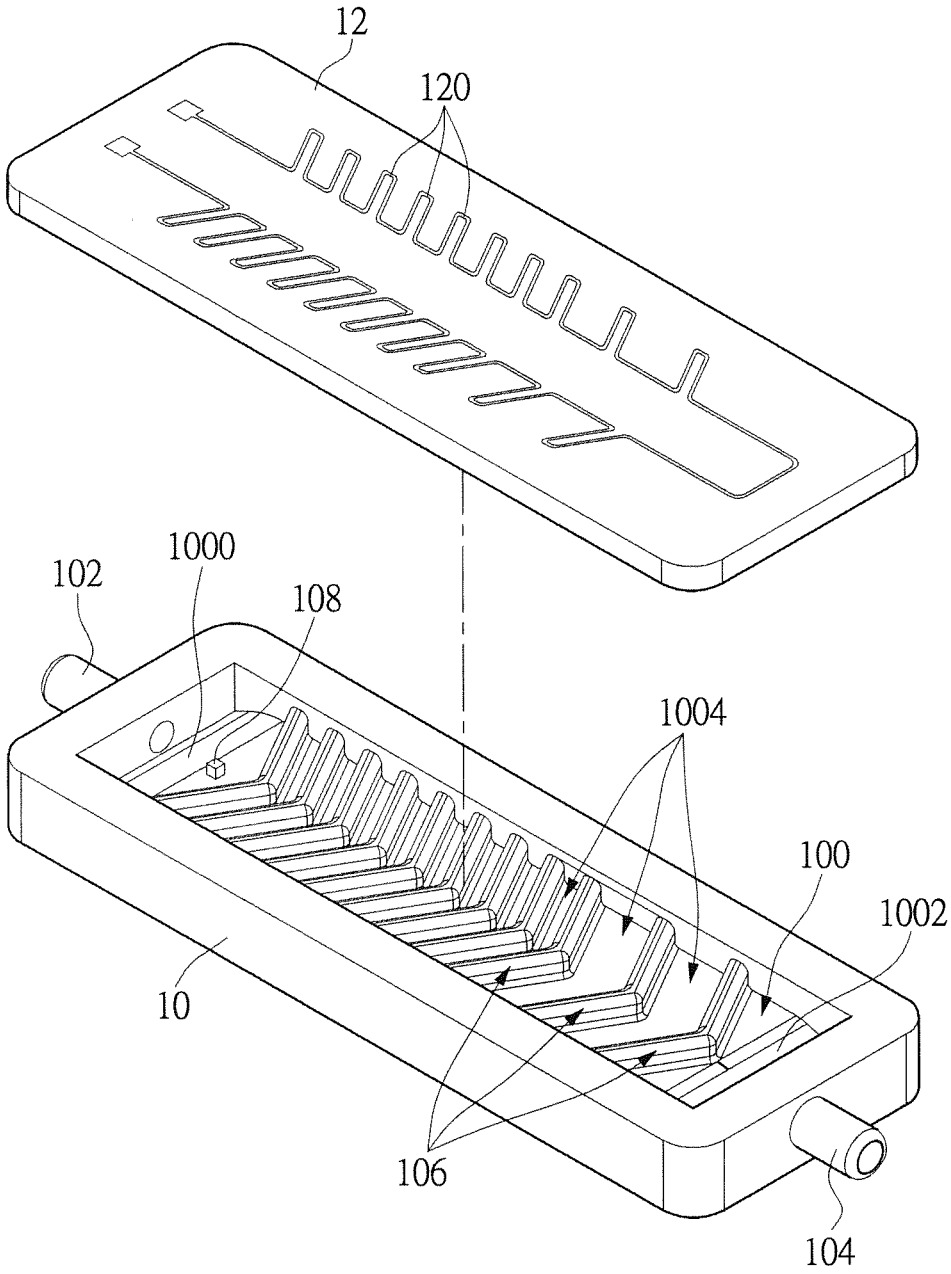
FIG. 2 shows a perspective exploded view of a heating module according to an embodiment of the present disclosure.

FIG. 2 shows a perspective exploded view of a heating module according to an embodiment of the present disclosure. As shown in FIG. 2, each heating module 1 includes a body 10 and a heating plate 12. The body 10 includes a groove 100, an input terminal 102, an output terminal 104, a plurality of ribs 106, a block 108 and a plurality of slits 1004. The heating plate 12 includes a plurality of heating units 120.

One side of the body 10 has a groove 100 through which liquid can flow. The input terminal 102 is positioned at one end of the groove 100 and is connected to the water tank 2 via the pump 3. The output terminal 104 is positioned at the other end of the groove and is connected to the water outlet 5 via the gas-liquid mixing module 4. In practice, the body 10 is made of heat resistant material and is a structure formed integrally or by assembly. The present disclosure does not limit the type of heat resistant material used, e.g. heat resistant plastic or glass. The body 10 has good heat insulation to avoid unnecessary heat loss.

Additionally, the groove 100 includes a first liquid-guiding slope 1000 formed between the input terminal 102 and the rib 106 closest to the input terminal 102, and a second liquid-guiding slope 1002 formed between the output terminal 104 and the rib 106 closest to the output terminal 104. The first liquid-guiding slope 1000 is deeper closer to the input terminal 102 than it is further from the input terminal 102. The second liquid-guiding slope 1002 is deeper closer to the output terminal 104 than it is further away from the output terminal 104. This configuration creates turbulence in liquid flowing past the first liquid-guiding slope 1000 and the second liquid-guiding slope 1002. The present disclosure does not limit the magnitudes of the slopes (namely the steepness) of the first liquid-guiding slope 1000 and the second liquid-guiding slope 1002, e.g. the slope of the first liquid-guiding slope 1000 can be steeper than the slope of the second liquid-guiding slope 1002.

The plurality of ribs 106 are formed on a bottom surface of the groove 100. The height of the plurality of ribs 106 protruding from the groove 100 is smaller than the depth of the groove 100. Two arms of each of the ribs 106 are respectively connected to two sidewalls of the groove 100. In practice, each of the ribs 106 can be a V-shaped rib, the midpoint of each rib 106 is the apex of the V-shaped rib, and the apex of the V-shaped rib points toward the output terminal 104. The angle between two arms on each of the ribs 106 is preferably 120 degrees such that-the vector sum of the directions of extension of the two arms of each rib 106 and the vector of the direction of extension of the apex are equal. However, the present disclosure is not limited thereto. Additionally, two arms of each of the ribs 106 can be curved or arced, and is not limited by the present disclosure.

It is worth noting that the arrangement density of the plurality of ribs 106 decreases from the input terminal 102 to the output terminal 104. Therefore, the distances between the ribs 106 closer to the input terminal 102 are smaller, and the distances between the ribs 106 closer to the output terminal 104 are larger. In other words, the slits 1004 formed between the ribs 106 in the groove 100 closer to the input terminal 102 are smaller, and the slits 1004 formed closer to the output terminal 104 are larger. If each of the ribs 106 is a V-shaped rib, each of the slits 1004 are correspondingly V-shaped slits.

Additionally, a block 108 is disposed between the input terminal 102 and the rib 106 closest to the input terminal 102. The direction of extension from the input terminal 102 to the block 108 intersects the midpoints of the ribs 106. In other words, if the ribs 106 are V-shaped ribs, then the direction of extension from the input terminal 102 to the block 108 intersects the apexes of the V-shaped ribs. The block 108 is used to create breaking waves in the fluid before the fluid flows to the plurality of ribs 106 and the heating plate 12.

One face of the heating plate 12 has a plurality of heating units 120. The plurality of heating units 120 converts electricity provided by the external power source B into heat, in order to heat the fluid injected into the heating module 1 from the water tank 2. In practice, the heating plate 12 covers the opening of the groove 100 and is not in contact with plurality of ribs 106, the plurality of heating units 120 is disposed on the face of the heating plate 12 away from the groove 100, and each of the heating units 120 corresponds to a slit 1004 formed between two neighboring ribs 106. In other words, any heat unit 120 on the heating plate 12 is aligned to its respective slit 1004.

It is worth noting that each of the heating units 120 is formed by at least one wired resistor, and the wired resistors between neighboring ribs 106 close to the input terminal 102 are more densely arranged than the wired resistors between neighboring ribs 106 close to the output terminal 104 are. In other words, the arrangement density of the wired resistors of the heating units 120 close to the input terminal 102 is higher so as to increase the rate of heat transfer. The arrangement density of the wired resistors close to the output terminal 104 is lower so as save electricity and avoid overheating and production of vapor.

In practice, the heating plate 12 can be a positive temperature coefficient heating plate (PTC) made of stainless steel. The preferred thickness of the heating plate is 1 to 2 millimeters, but is not limited thereto. A person skilled in the art can design the heating plate 12 according to practical conditions and choose the appropriate thickness and material.

Figure 3:
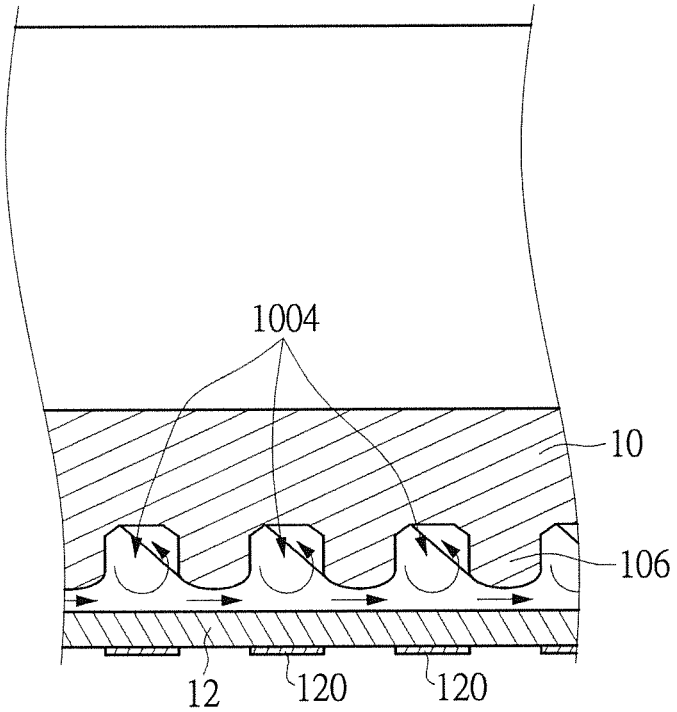
FIG. 3 shows a cross-sectional view of the heating module of FIG. 2 during operation.

Please refer to FIG. 3 for a more detailed description of the flow of liquid in the heating module 1. FIG. 3 shows a cross-sectional view of the heating module of FIG. 2 under operation. As shown in FIG. 3, the heating units 120 on the heating plate 120 correspond respectively to the slits 1004 on the body 10. When liquid flows between two neighboring ribs 106 and the heating plate 12, the liquid proximal to the heat plate 12 is instantaneously heated by the heating unit 120 to provide convective heat transfer, and a convection cell is created between the two neighboring ribs 106 and the heating plate 12 via thermal convection.

More specifically, when liquid proximal to the heat plate 12 is heated by the heating unit 120 and increases in temperature, due to difference in density between cold and hot water, the hot water having lower density flows toward the slit 1004, and the cold water having higher density flows toward the heating plate 12. By this configuration, as the pump 3 continually pumps liquid from the water tank 2 into the heating module 1, the liquid not only flows toward the output terminal 104 of the heating module 1, but also in convection cells formed in each of the slits 1004 due to the effects of the heating module 1 so as to increase the rate of heat transfer.

Additionally, the heating plate 12 can have a temperature sensor (not illustrated in the figures) for sensing the temperature of the heating plate 12. When the temperature of the heating plate 12 exceeds a default threshold value, electrical connection with the external power source B is cut off to protect the water dispensing device for providing instantaneous heating A.

It is worth noting that the present disclosure does not limit the minimum distance between the plurality of ribs 106 and the heating plate 12 (the gap therebetween forms a channel for fluid to flow toward the output terminal 104, as shown by horizontal arrows in FIG. 3), nor the height of protrusion of the plurality of ribs 106. A person skilled in the art can design appropriate height of the channel and height of the ribs 106 according to practical needs. Preferably, the minimum distance between the plurality of ribs 106 and the heating plate 12 is a predetermined distance directly proportional to the height of protrusion of the ribs 106 and the amount of electricity provided by the external power source B to each heating unit 120. In order to achieve thermal equilibrium and optimal rate of heat transfer, the predetermined distance=(amount of electrical power provided to each heating unit 120 by the external power source B)/(thermal conductivity of water*difference in temperature between the fluid and each of the heating unit 120). The difference in temperature between the fluid and each of the heating unit 120 ($\Delta T$)=(mass flow rate of fluid injected into the heating module 1*specific heat of water)$^{-1}$*electrical power provided by the external power source. The thermal conductivity of water under room temperature is 0.58 $Wm^{-1}K^{-1}$.

Additionally, the present disclosure does not limit the placement of the heating module 1 in the water dispensing device for providing instantaneous heating A. For example, the heating module 1 can be placed vertically or slantedly in the water dispensing device for providing instantaneous heating A (the input terminal 102 is closer than the output terminal 104 is to the surface on which the water dispensing device for providing instantaneous heating A is disposed). The heating module 1 can also be placed horizontally in the water dispensing device for providing instantaneous heating A.

Referring to FIG. 1 and FIG. 2, the gas-liquid mixing module 4 converts fluid output by the heating module 1 (including hot liquid and vapor) into hot liquid to prevent spreading of vapor, achieving efficiency of heat transfer. In practice, the gas-liquid mixing module 4 can be a long narrow tube, and the water outlet 5 can be an intake valve.

[Another Embodiment of a Water Dispensing Device for Providing Instantaneous Heating]

Figure 4:
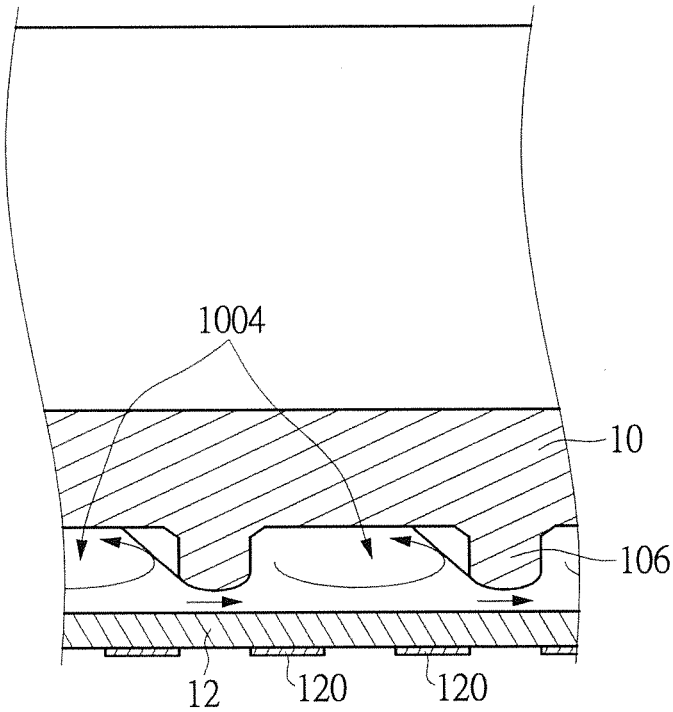
FIG. 4 shows a cross-sectional view of a heating module according to another embodiment of the present disclosure under operation.

FIG. 4 shows a cross-sectional view of a heating module according to another embodiment of the present disclosure under operation. As shown in FIG. 4, when the distance between to neighboring ribs 106 is relatively large (namely the slit 1004 is larger), more than one heating units 120 can be disposed correspondingly to the slit 1004. For example in FIG. 4, each of the slits 1004 corresponds to two heating units 120. The practical application of the heating module in FIG. 4 is similar to that of the heating module in FIG. 3, and is therefore not further detailed.

[Potential Advantages of the Embodiments]

In summary, the present disclosure provides a water dispensing device for providing instantaneous heating and a heating module thereof. The heating module mainly includes a body and a heating plate. Through the design of spaced ribs and heating units on the heating plate corresponding to gaps between neighboring ribs, when water flows through the regions between two neighboring ribs and the heating plate, water proximal to the heating plate is instantaneously heated and convective current is created, forming a convection cell in the region between the two neighboring ribs and the heating plate. By this configuration, the water dispensing device for providing instantaneous heating and the heating module thereof according to the present disclosure have very high effective rate of heat transfer. Not only can output liquid be maintained at a predetermined temperature, but unnecessary consumption of electrical power is also avoided by the functioning of the heating module.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A heating module, electrically connected to an external power source, comprising:

a body, including:

a groove;

an input terminal, positioned at one end of the groove;

an output terminal, positioned at the other end of the groove; and a plurality of ribs, formed on the bottom face of the groove, wherein the height of protrusion of the ribs is smaller than the depth of the groove, two arms of each of the ribs are respectively connected to two side walls of the groove, and the arrangement density of the plurality of ribs decreases from the input terminal to the output terminal; and a heating plate, covering the opening of the groove and not in contact with the ribs, wherein the face of the heating plate facing away from the groove has a plurality of heating units, each of the heating units corresponds to a region between two of the neighboring ribs, and the heating units convert electrical power into heat for heating the water injected from a water tank.

2. The heating module according to claim 1, wherein the body includes a block disposed between the input terminal and the rib closest to the input terminal, and the direction of extension from the input terminal to the block intersects the midpoints of the ribs.

3. The heating module according to claim 1, wherein the groove includes a first liquid-guiding slope formed between the input terminal and the rib closest to the input terminal, and a second liquid guiding slope formed between the output terminal and the rib closest to the output terminal, a depth of the first liquid-guiding slope proximal to the input terminal is larger than depth of the first liquid-guiding slope distal from the input terminal, and a depth of the second liquid-guiding slope proximal to the output terminal is larger than a depth of the second liquid-guiding slope distal from the output terminal.

4. The heating module according to claim 1, wherein the ribs are V-shaped ribs, and the midpoint of each of the ribs is a pointed apex pointing towards the output terminal.

5. The heating module according to claim 4, wherein the included angle of the two arms of each of the ribs is 120 degrees.

6. The heating module according to claim 1, wherein the minimum distance between the plurality of ribs and the heating plate is a predetermined distance, the predetermined distance is directly proportional to the protruding height of the ribs and the electric power provided to each of the heating units by the external power source.

7. The heating module according to claim 1, wherein each of the heating units is formed by at least one wired resistor, and the arrangement density of the at least one wired resistors between two neighboring ribs proximal to the input terminal is higher than the arrangement density of the at least one wired resistors between two neighboring ribs proximal to the output terminal.

8. A water dispensing device for providing instantaneous heating, electrically connected to an external power source, comprising:

a water tank; and at least one heating module, each of which includes:

a body, including:

a groove;

an input terminal, positioned at one end of the groove;

an output terminal, positioned at the other end of the groove; and a plurality of ribs, formed on the bottom face of the groove, wherein the height of protrusion of the ribs is smaller than the depth of the groove, two arms of each of the ribs are respectively connected to two side walls of the groove, and the arrangement density of the plurality of ribs decreases from the input terminal to the output terminal; and a heating plate, covering the opening of the groove and not in contact with the ribs, wherein the face of the heating plate facing away from the groove has a plurality of heating units, each of the heating units corresponds to a region between two of the neighboring ribs, and the heating units convert electrical power into heat for heating the water injected from the water tank;

wherein when liquid flows through the region between two neighboring ribs and the heating plate, the liquid proximal to the heating plate is heated instantly and convective heat transfer is created therein, and a convection cell is created between the two neighboring ribs and the heating plate.

9. The water dispensing device for providing instantaneous heating according to claim 8, wherein the body includes a block disposed between the input terminal and the rib closest to the input terminal, the direction of extension from the input terminal to the block intersects the midpoints of the ribs, and the block creates breaking waves in a liquid before the liquid flows to the plurality of ribs and the heating plate.

10. The water dispensing device for providing instantaneous heating according to claim 8, wherein the groove includes a first liquid-guiding slope formed between the input terminal and the rib closest to the input terminal, and a second liquid guiding slope formed between the output terminal and the rib closest to the output terminal, a depth of the first liquid-guiding slope proximal to the input terminal is larger than a depth of the first liquid-guiding slope distal from the input terminal, and a depth of the second liquid-guiding slope proximal to the output terminal is larger than a depth of the second liquid-guiding slope distal from the output terminal, creating turbulence in the fluid flowing past the first liquid-guiding slope and the second liquid-guiding slope.

11. The water dispensing device for providing instantaneous heating according to claim 8, wherein the ribs are V-shaped ribs, and the midpoint of each of the ribs is a pointed apex pointing towards the output terminal.

12. The water dispensing device for providing instantaneous heating according to claim 11, wherein the included angle of the two arms of each of the ribs is 120 degrees.

13. The water device dispensing for providing instantaneous heating according to claim 8, wherein the minimum distance between the plurality of ribs and the heating plate is a predetermined distance, the predetermined distance is directly proportional to the protruding height of the ribs and the electric power provided to each of the heating units by the external power source.

14. The water dispensing device for providing instantaneous heating according to claim 8, wherein each of the heating units is formed by at least one wired resistor, and the arrangement density of the at least one wired resistors between two neighboring ribs proximal to the input terminal is higher than the arrangement density of the at least one wired resistors between two neighboring ribs proximal to the output terminal.

15. A body, comprising:

a groove;

an input terminal, positioned at one end of the groove;

an output terminal, positioned at the other end of the groove; and a plurality of ribs, formed on the bottom face of the groove, wherein the height of protrusion of the ribs is smaller than the depth of the groove, two arms of each of the ribs are respectively connected to two side walls of the groove, and the arrangement density of the plurality of ribs decreases from the input terminal to the output terminal.

16. The block according to claim 15, further comprising a block disposed between the input terminal and the rib closest to the input terminal, and the direction of extension from the input terminal to the block intersects the midpoints of the ribs.

17. The block according to claim 15, wherein the groove includes a first liquid-guiding slope formed between the input terminal and the rib closest to the input terminal, and a second liquid guiding slope formed between the output terminal and the rib closest to the output terminal, a depth of the first liquid-guiding slope proximal to the input terminal is larger than a depth of the first liquid-guiding slope distal from the input terminal, and a depth of the second liquid-guiding slope proximal to the output terminal is larger than a depth of the second liquid-guiding slope distal from the output terminal.

18. The block according to claim 15, wherein the ribs are V-shaped ribs, and the midpoint of each of the ribs is a pointed apex pointing towards the output terminal.

19. The block according claim 18, wherein the included angle of the two arms of each of the ribs is 120 degrees.

* * * * *